US007296949B2

(12) United States Patent
Raether

(10) Patent No.: US 7,296,949 B2
(45) Date of Patent: Nov. 20, 2007

(54) REMOVAL OF OBSOLETE DRILL PLATFORMS FROM INLAND SEAS AND OCEAN FLOORS

(75) Inventor: Roger Raether, Sioux Falls, SD (US)

(73) Assignee: Under Pressure Systems, Inc., New Philadelphia, OH (US)

( * ) Notice: Subject to any disclaimer, the term of this patent is extended or adjusted under 35 U.S.C. 154(b) by 0 days.

(21) Appl. No.: 11/175,972

(22) Filed: Jul. 6, 2005

(65) Prior Publication Data

US 2006/0127186 A1 Jun. 15, 2006

Related U.S. Application Data

(60) Provisional application No. 60/586,111, filed on Jul. 7, 2004.

(51) Int. Cl.
*E02D 9/00* (2006.01)
*E02D 7/18* (2006.01)
*E02D 13/00* (2006.01)

(52) U.S. Cl. ..... 405/232; 173/1; 173/49

(58) Field of Classification Search ..... 405/228; 166/177.6; 173/1, 49
See application file for complete search history.

(56) References Cited

U.S. PATENT DOCUMENTS 3,056,267 A * 10/1962 McRee ..... 405/191
3,466,878 A * 9/1969 Esquillan et al. ..... 405/203
4,603,748 A 8/1986 Rossfelder et al.
4,693,325 A 9/1987 Bodine
5,549,168 A 8/1996 Sadler et al.
5,562,169 A 10/1996 Barrow
5,725,329 A * 3/1998 Chelminski ..... 405/232
5,771,985 A 6/1998 Jaworski
5,794,716 A 8/1998 White
6,129,487 A 10/2000 Bermingham et al.
6,345,546 B1 2/2002 Houze
2001/0053311 A1* 12/2001 Jones ..... 405/203

OTHER PUBLICATIONS http://en.wikipedia.org/wiki/Three-phase_electric_power.*

* cited by examiner

*Primary Examiner*—Tara L. Mayo
(74) *Attorney, Agent, or Firm*—The Webb Law Firm

(57) ABSTRACT

The present invention is a method for removing an obsolete drill platform that includes a body having a plurality of caissons embedded in a ground of an ocean or inland sea. The method includes the steps of vibrating at least one of the caissons, and lifting the at least one caisson from the ground while it is still being vibrated. The present invention is further directed to a method for installing a caisson on a floor of an ocean or inland. The method includes the steps of placing an end of the caisson on the floor, vibrating the caisson and forcing a portion of the caisson into the floor.

9 Claims, 3 Drawing Sheets

REMOVAL OF OBSOLETE DRILL PLATFORMS FROM INLAND SEAS AND OCEAN FLOORS

CROSS REFERENCE TO RELATED APPLICATIONS

This application claims the benefit of U.S. Provisional Patent Application No. 60/586,111, filed Jul. 7, 2004, entitled "Removal of Obsolete Drill Platforms from Inland Seas and Ocean Floors", the disclosure of which is hereby incorporated by reference.

BACKGROUND OF THE INVENTION

1. Field of the Invention

The present invention relates to the removal of obsolete drill platforms from inland seas and ocean floors.

2. Description of Related Art

Presently, drill platforms are used in oil and gas exploration in inland seas and ocean floors. After a period of time, the platforms become obsolete because gas and oil can no longer be extracted from the sea floor and ocean floor.

Several options currently exist for the removal of drill platforms after they have become obsolete. However, these options suffer from various drawbacks. First, a crane or other lifting device may be used to remove the caissons of a drill platform that were hammered into the soft mud or sand of the ocean floor. This method has achieved only very limited success and will not work with larger caissons.

Another method is to use explosives either above or below the mud line surrounding the caisson. While this method is both quick and inexpensive, it has a drastic, negative effect on marine life. The shock waves of such explosives tend to kill sensitive marine organisms and other living creatures. Furthermore, the byproduct residue from the explosions is detrimental to marine organisms and animals in the immediate area of the explosion as well as more distant areas.

A third method of removal is for divers to use various cutting tools, such as cutting torches, high-pressure water with an abrasive assist and diamond chain saws, to remove the caissons. This method also has a variety of drawbacks. First, this type of removal is dangerous for the divers. Further, some of the abrasive assists used with a high-pressure water cutting device are not environmentally friendly. Finally, since the caissons cannot be cut below the mud line, jagged edges are left above or near the mud line which could endanger future recreational divers and any future undersea cables, pipelines or the like.

A final method is to merely leave the platforms in place or modify them so a portion of the platform remains under water for the formation of a coral reef. This method is generally unacceptable or impossible. Furthermore, the United States Federal Government has recently instituted regulations for the removal of obsolete drill platforms. These new regulations have been implemented primarily because of environmental concerns. These regulations require the owner to take responsibility for all platforms in federal waters, the owner of a platform to remove the structure 15 feet below the mud line once it has become obsolete and obtain a permit to create an artificial reef.

Accordingly, a need exists for a method for removal of obsolete drill platforms that overcomes the drawbacks of the prior art methods for removal and conforms to the new United States Federal Government regulations.

SUMMARY OF THE INVENTION

The present invention is a method for removing an obsolete drill platform that includes a body having a plurality of caissons embedded in a ground of an ocean or inland sea. Specifically, the method includes the steps of vibrating at least one of the caissons, and lifting the at least one caisson from the ground while it is still being vibrated. The drill platforms include a drill deck attached to a plurality of caissons. The embedded portion of the caissons is surrounded by mud and/or sand. The step of vibrating causes liquefaction of the at least one of sand and mud. The at least one caisson can be vibrated at approximately 150 hertz or greater and, most desirably, at approximately 180 hertz.

The method may also include the step of attaching at least one vibrator to the at least one caisson prior to vibrating the at least one caisson. Three vibrators may be attached to the caisson and powered by a three-phase motor. The method may further include the step of lifting the at least one caisson with a crane and transporting it by boat.

The present invention is further directed to a method for installing a caisson on a floor of an ocean or inland. The method includes the steps of placing an end of the caisson on the floor, vibrating the caisson and forcing a portion of the caisson into the floor.

The present invention is also directed to an apparatus for removing an obsolete drill platform that includes a body having a plurality of caissons embedded in a ground of an ocean or inland sea. The apparatus includes at least one vibrator configured to be attached to one of the plurality of caissons, and a three-phase motor attached to the at least one vibrator for supplying power to the at least one vibrator. Desirably, three vibrators are attached to at least one of the plurality of caissons.

Further details and advantages of the present invention will become apparent upon reading the following detailed description in conjunction with the accompanying drawings.

DESCRIPTION OF THE PRESENT INVENTION

The present invention will be described with reference to the accompanying figures where like reference numbers correspond to like elements.

Figure 1:
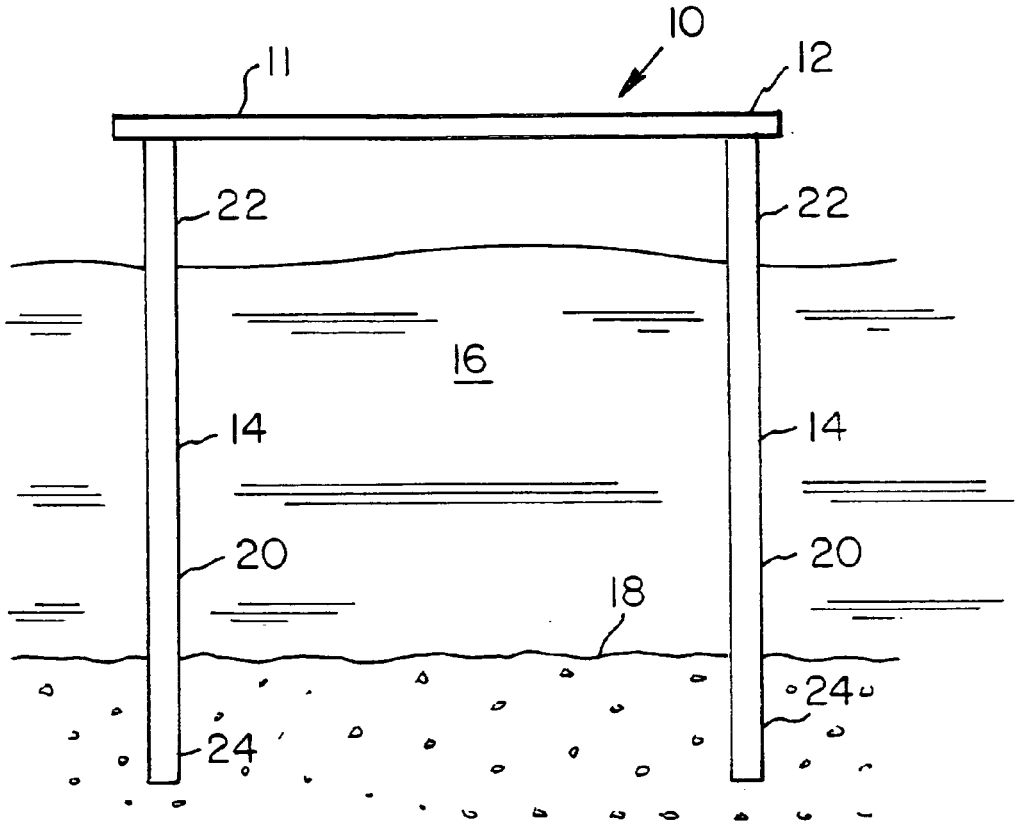
FIG. 1 is a side elevational view of a conventional drill platform attached to an inland sea or ocean floor.

With reference to FIG. 1, an oil drill platform 10 includes a body 11 with a deck 12 having a plurality of caissons 14 attached thereto. Typically, caissons 14 are partially submerged in less than 200 ft. of water 16. Caissons 14 are then embedded in the mud and/or sand that makes up a floor or ground 18 of an inland sea or ocean. Specifically, caissons 14 include three sections, a submerged portion 20, an unsubmerged portion 22 and an embedded portion 24. Each of the caissons 14 typically weighs approximately 600,000-800,000 lbs. However, this is not to be construed as limiting the present invention since it is envisioned that either heavier or lighter caissons 14 may be used.

Figure 2:
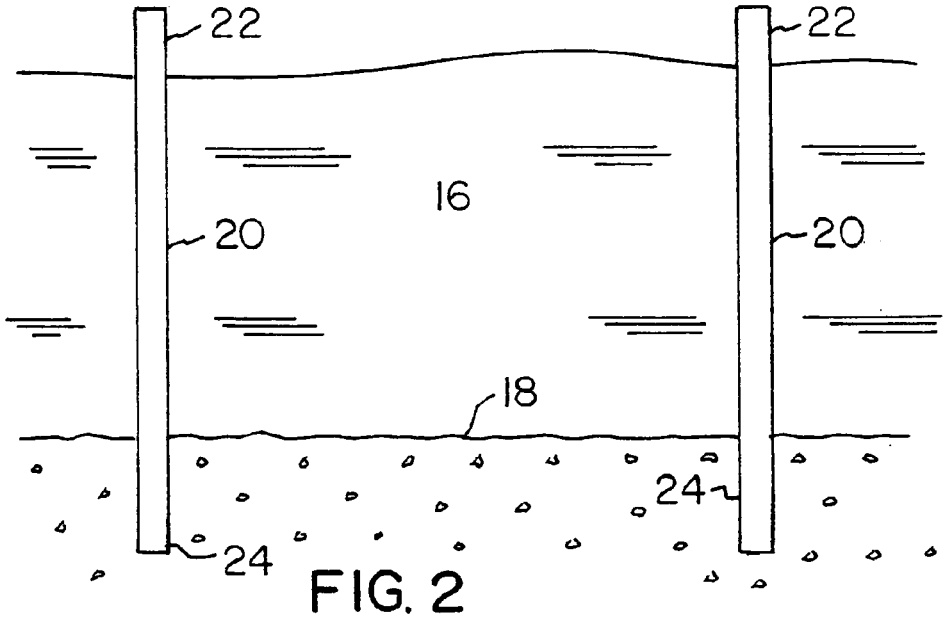
FIG. 2 is a side elevational view of the conventional drill platform shown in FIG. 1 with the deck removed.

With reference to FIG. 2 and with continuing reference to FIG. 1, at the time it is decided that oil drill platform 10 has become obsolete and must be removed, deck 12 and a portion of caissons 14 at section 22 are removed, so that only approximately 20 ft. of the caissons extends above water 16.

Figure 3:
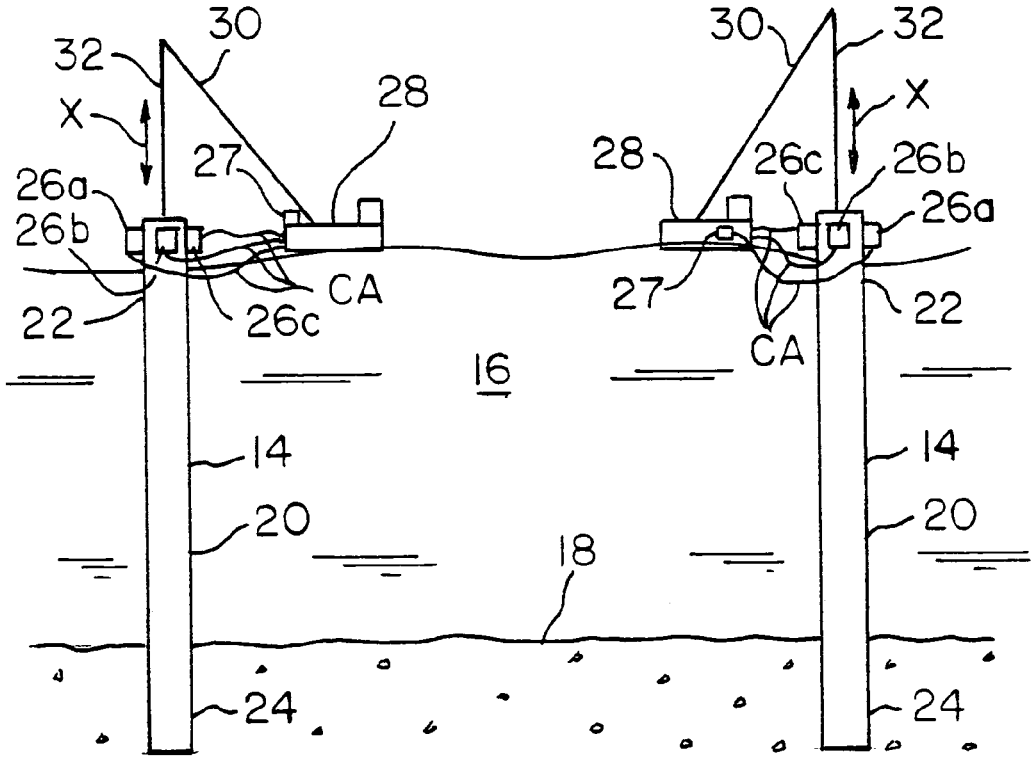
FIG. 3 is a side elevational view of a plurality of caissons from a drill platform with vibrators attached thereto in accordance with the present invention.

With reference to FIG. 3, one, non-limiting method of removing an obsolete drill platform according to the present invention includes attaching a plurality of vibrators 26*a*, 26*b* and 26*c* to caissons 14 at portion 22 of the caissons 14. Typically, vibrators 26*a*-26*c* vibrate at least approximately 150 hertz. At this high frequency, the mud and/or sand surrounding caissons 14 vibrate, causing liquid entrapped between the sand and/or mud to collect around caissons 14, thereby reducing the strength and stiffness of the sand and/or mud surrounding caissons 14. This process is referred to as liquefaction. Once liquefaction has occurred, caissons 14 may be easily removed.

A typical vibrator for use with the present invention is a V-500 vibrator manufactured by FMC Technologies, Inc. Typically, these vibrators are adapted to vibrate at approximately 60 hertz along a vertical axis x. Vibrators 26*a*-26*c* are connected to a three-phase motor 27 through wire cables CA and are triggered via diodes (not shown). Vibrators 26*a*-26*c* are each driven by one of the phases of the motor 27 and are offset by 120°. This arrangement will result in each vibrator 26*a*-26*c* operating at 60 hertz. However, the combined effect of vibrators 26*a*-26*c* will vibrate each of the caissons 14 at 180 hertz. Alternatively, the vibration can be 150 hertz from a three-phase sine wave generator. The use of such vibrating configurations is not to be construed as limiting the present invention since it is envisioned that any type of triggering mechanism may be used to cause vibration. As caissons 14 are vibrated, liquefaction of the sand and/or mud of floor 18 will take place, thus allowing caissons 14 to be easily removed by cranes 30 mounted on boats 28. Once caissons 14 are removed, cranes 30 may then lift them via cables 32 from floor 18.

Figure 4:
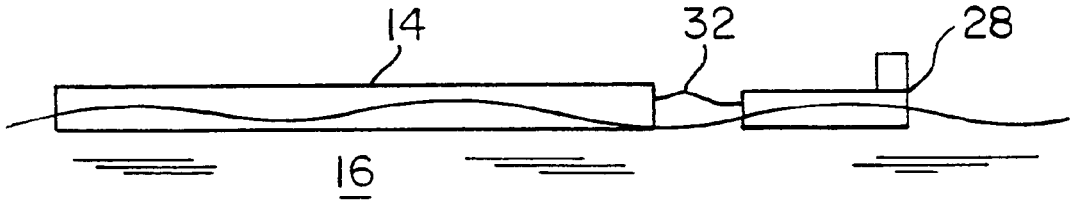
FIG. 4 is a side elevational view of a removed caisson being transported by a boat in accordance with the present invention.

With reference to FIG. 4 and with continuing reference to FIG. 3, once caissons 14 are lifted out of water 16, they are laid on their sides and towed away by boot 28 via cables 32 so that they may either be reused or sold as scrap.

Figure 5:
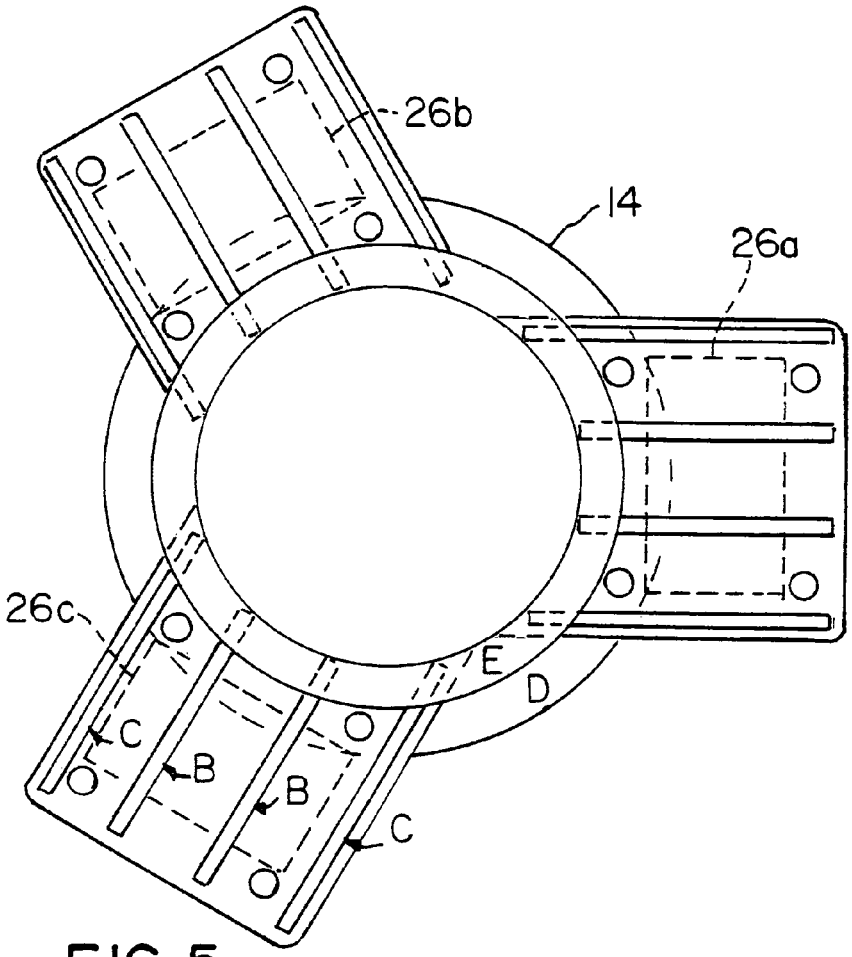
FIG. 5 is a top plan view of a support structure for attaching to caisson and holding a vibrator.
Figure 6:
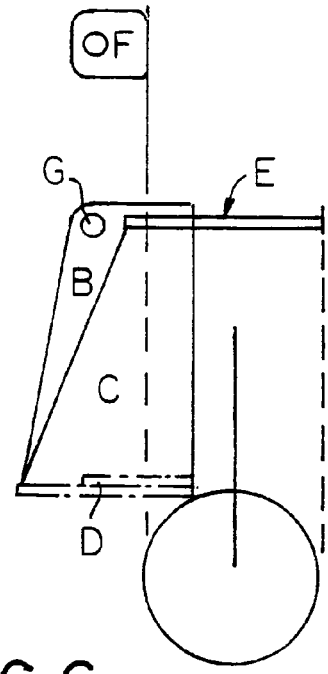
FIG. 6 is an exploded elevational view of the support structure shown in FIG. 5.

With reference to FIGS. 5 and 6, vibrators 26*a*-26*c*, in the proposed operating frequency combinations, have the distinct possibility of causing an under-designed single steel weldment to fail because of metal fatigue. In order to prevent such a failure from occurring, the present invention includes several steel gussets B and C for each vibrator 26*a*-26*c* welded to caisson 14 in concert with two large mounting rings D and E.

The mounting rings D and E also serve as an arrangement for distributing the vibrational force uniformly onto and into caisson 14. The steel gussets B and C must be of sufficient mass and length prevent failure due to high frequency vibration.

Mounting plate F is welded to caisson 14 for installation. Hole G in the gusset weldment assembly is also used for installation. A lifting device is attached to mounting plate F and hole G to lift the weldment assembly in place.

The above process may be reversed, whereby liquefaction can be used to install caissons 14 on ocean or sea floor 18. Specifically, each of caissons 14 is arranged such that an end of caisson 14 abuts floor 18. Vibrators 26*a*-26*c* are attached to caissons 14, which are then attached to three-phase motor 27. Caissons 14 are vibrated about the X axis at approximately 180 hertz (each vibrator 26 vibrates at 60 hertz 120° out of phase) so that liquefaction takes place. Caisson 14 is then forced into floor 18.

While the present invention was described with reference to preferred embodiments of the method for removing an obsolete drill platform, those skilled in the art may make modifications and alterations to the present invention without departing from the scope and spirit of the present invention. Accordingly, the above detailed description is intended to be illustrative rather than restrictive. The invention is defined by the appended claims, and all changes to the invention that fall within the meaning and range of equivalency of the claims are to be embraced by their scope.

The invention claimed is:

1. A method for removing an obsolete drill platform that includes a body having a plurality of caissons embedded in a ground of an ocean or inland sea, the method comprising the steps of:

attaching at least three vibrators directly to each one of the caissons, the three vibrators are positioned offset by 120°;

driving a first vibrator with a first phase of a three-phase generator, driving a second vibrator with a second phase of the three-phase generator and driving a third vibrator with a third phase of the three-phase generator thereby vibrating each of the caissons; and lifting each of the caissons from the ground while it is still being vibrated.

2. The method of claim 1, wherein the ground of the ocean or inland sea is made up of at least one of sand and mud.

3. The method of claim 2, wherein the vibrating causes liquefaction of at least one of sand or mud.

4. The method of claim 3, wherein each of the caissons are vibrated at approximately 150 hertz or greater.

5. The method of claim 4, wherein each of the caissons are vibrated at approximately 180 hertz.

6. The method of claim 1, further comprising the step of lifting each of the caissons with a crane.

7. The method of claim 1, further comprising the step of transporting at least one caisson that has been lifted by a boat.

8. A method for installing a caisson on a floor of an ocean or inland sea comprising the steps of:

placing an end of the caisson on the floor;

attaching at least three vibrators directly to the caisson, the three vibrators are positioned offset by 120°;

driving a first vibrator with a first phase of a three-phase generator, driving a second vibrator with a second phase of the three-phase generator and driving a third vibrator with a third phase of the three-phase generator thereby vibrating the caisson; and forcing a portion of the caisson into the floor.

9. An apparatus for removing an obsolete drill platform that includes a body having a plurality of caissons embedded in a ground of an ocean or inland sea, the apparatus comprising;

at least three vibrators attached directly to one of the plurality of caissons, the three vibrators are positioned offset by 120°; and a three-phase generator attached to each of the three vibrators for driving a first vibrator with a first phase of the three-phase generator, driving a second vibrator with a second phase of the three-phase generator and driving a third vibrator with a third phase of the three-phase generator thereby.

* * * * *